US007007771B2

(12) United States Patent
Rawlings et al.

(10) Patent No.: US 7,007,771 B2
(45) Date of Patent: Mar. 7, 2006

(54) COLLAPSIBLE STOOL

(76) Inventors: Shelley Rawlings, 11317 Kencrest Dr., Mitchellville, MD (US) 20721; Bryan Rawlings, 11317 Kencrest Dr., Mitchellville, MD (US) 20721

( * ) Notice: Subject to any disclaimer, the term of this patent is extended or adjusted under 35 U.S.C. 154(b) by 295 days.

(21) Appl. No.: 10/685,528

(22) Filed: Oct. 16, 2003

(65) Prior Publication Data

US 2004/0084249 A1 May 6, 2004

Related U.S. Application Data

(60) Provisional application No. 60/422,090, filed on Oct. 30, 2002.

(51) Int. Cl.
*A47B 3/00* (2006.01)

(52) U.S. Cl. ..... 182/33; 248/431; 108/132

(58) Field of Classification Search ..... 182/33, 182/222, 223; 248/431; 297/423.39; 108/129, 108/132, 133

See application file for complete search history.

(56) References Cited

U.S. PATENT DOCUMENTS

| | | | | |
|---|---|---|---|---|
| 163,833 | A * | 5/1875 | Williams | 108/26 |
| 3,650,562 | A | 3/1972 | Adler | |
| 3,841,437 | A | 10/1974 | Caughey | |
| 3,857,343 | A | 12/1974 | Greenberg | |
| 4,010,699 | A | 3/1977 | Lasko | |
| 4,244,064 | A | 1/1981 | Parr | |
| 4,383,488 | A * | 5/1983 | Macho et al. | 108/129 |
| 4,437,413 | A | 3/1984 | O'Brian et al. | |
| 4,471,969 | A | 9/1984 | Zabala | |
| D297,789 | S | 9/1988 | Stepien | |
| 5,085,290 | A | 2/1992 | Guirlinger | |
| 5,094,505 | A | 3/1992 | Nichols | |
| 5,127,647 | A | 7/1992 | Wilkinson | |
| D339,179 | S | 9/1993 | Wilkinson | |
| 5,394,808 | A * | 3/1995 | Dutro et al. | 108/126 |
| 5,547,412 | A | 8/1996 | Wilcox | |
| D379,271 | S | 5/1997 | Starck | |
| 5,641,034 | A | 6/1997 | Calmeise et al. | |
| 5,967,255 | A | 10/1999 | Young | |
| 6,000,346 | A * | 12/1999 | Pajerski et al. | 108/158.11 |
| 6,076,635 | A | 6/2000 | Dame | |
| 6,158,552 | A | 12/2000 | Gould et al. | |
| 6,837,171 | B1 * | 1/2005 | Clark et al. | 108/131 |

* cited by examiner

*Primary Examiner*—Alvin Chin-Shue
(74) *Attorney, Agent, or Firm*—Richard C. Litman

(57) ABSTRACT

A collapsible stool to provide additional height for small children undergoing toilet training, comprising: a substantially horizontal top plate of generally rectangular shape with an upper surface and a lower surface; four protrusions integral with the lower plate surface and each separately located proximal to the four corners of the top plate, wherein each protrusion is host to a hollow core to provide two pairs of female cores approximately cylindrical in shape; and two legs, each leg having two opposite facing male protrusions each adapted to fit the female cores to enable each leg to rotate through an arc between an open position and a closed position relative to the top plate, wherein at least one of each pair of female cores comprise an integral leg security mechanism adapted to maintain each leg in an open position relative to the top plate.

11 Claims, 12 Drawing Sheets

COLLAPSIBLE STOOL

CROSS-REFERENCE TO RELATED APPLICATION

This application claims the benefit of U.S. Provisional Patent Application Ser. No. 60/422,090, filed Oct. 30, 2002.

FIELD OF THE INVENTION

The present invention relates to an adjustable and collapsible stool suitable for use by children who require additional elevation when using a toilet particularly during the toilet training phase of child development.

DESCRIPTION OF RELATED ART

Small children often have difficulty using common every day things such as urinals, toilets, and wash basins, which are typically designed for adults of average height. Also, small children often face difficulties when traveling with their family particularly in hotel rooms where such facilities are designed for adult use.

Other places that present problems for small children include rest rooms in e.g. restaurants, shopping malls, and hotels. Problems often arise for small children who are not tall enough to reach or use facilities more commonly used by adults or designed for adult use.

Several efforts have been made to address these problems. U.S. Pat. No. D297,789, issued Sep. 27, 1988 to J. C. Stepien shows an ornamental design of a foot support stool for toilets. The '789 design is somewhat clumsy in design and use. For example, the '789 design can not be folded up and carried, and is not designed to be used with, for example, a modern day urinal as found, for example, in most public male toilet facilities at e.g. airports.

U.S. Pat. No. 3,650,562, issued Mar. 21, 1972 to L. Adler shows a folding footstool with a main structure and a foot supporting portion with a pair of pedestals supporting the main structure. In its inoperative position, hingeable panels form the main structure and are adapted to embrace the pedestals to provide a box like form claimed to be suitable for carrying a load. Thus, the '562 footstool takes the form of a bulky box, which is not easy to carry.

U.S. Pat. Design No. 339,179, issued Sep. 7, 1993 to W. T. Wilkinson shows an ornamental design for an exercise step. The legs of the exercise step lack a footprint large enough to provide firm contact with, for example, uneven or uncertain ground such as that around a public toilet where splashes of water may be present.

U.S. Pat. Des. No. 379,271, issued May 20, 1997 to P. Starck shows an ornamental design for a foot rest. The foot rest is rather large and cumbersome for a child to use with ease. Thus, there is a requirement for a less cumbersome device suitable for small children.

U.S. Pat. No. 3,841,437, issued Oct. 15, 1974 to J. W. Caughey shows a portable step stool to reach high places. The stool design includes a vertical post which makes the stool unsuitable for use in providing height assistance to small children using e.g., public facilities.

U.S. Pat. No. 4,010,699, issued Mar. 8, 1977 to E. E. Lasko shows a self-erecting step stool comprising a top, pivoted leg structures at the ends of the top, a pivoted leg holding strut between the legs and having positive engagement therewith when the legs are extended with a strengthening rib operatively connected to the legs such that if a sidewise force is applied to the legs the force is transmitted through the rib to the top of the stool. The Lasko '699 stool is too complicated for a child to use.

U.S. Pat. No. 4,244,064, issued Jan. 13, 1981 to L. C. Parr shows a step stool comprising a U-shaped opening with at least one elevated step in front of the U-shaped opening. While the Parr '064 step stool is cumbersome and bulky, thus compromising portability.

U.S. Pat. No. 6,158,552, issued Dec. 12, 2000 to M. J. Gould and G. W. Gould shows an adjustable locking step stool comprising a plurality of adjustment bars and at least one locking pin to vary the height of the stool. The '552 stool is not suitable for a child or a non-mechanically minded person.

Other patents showing folding structures and stools of various kinds but which do not address the aforementioned problems include U.S. Pat. No.: 3,857,343 issued Dec. 31, 1974 to S. Greenberg; U.S. Pat. No. 4,437,413, issued Mar. 20, 1984 to E. D. O'Brian and C. Phelan; U.S. Pat. No. 4,383,488 issued May 17, 1983 to J. M. Macho and R. O. Oxford; U.S. Pat. No. 4,471,969, issued Sep. 18, 1984 to T. A. Zabala and D. L. Affleck; U.S. Pat. No. 5,085,290, issued Feb. 4, 1992 to E. C. Guirlinger; U.S. Pat. No. 5,094,505, issued Mar. 10, 1992 to K. Nichols; U.S. Pat. No. 5,127,647, issued Jul. 7, 1992 to W. T. Wilkinson; U.S. Pat. No. 5,547,412, issued Aug. 20, 1996 to J. J. Wilcox; U.S. Pat. No. 5,641,034, issued Jun. 24, 1997 to R. W. Calmeise and D. L. O'Neal; U.S. Pat. No. 5,967,255, issued Oct. 19, 1999 to D. D. Young; and U.S. Pat. No. 6,076,635, issued Jun. 20, 2000 to D. Dame.

None of the above inventions and patents, taken either singly or in combination, is seen to describe the instant invention as claimed. Thus, a collapsible stool solving the aforementioned problems is desired.

SUMMARY OF THE INVENTION

The invention is directed to a portable collapsible stool to provide additional height for small children, comprising a substantially horizontal top plate of generally rectangular shape with an upper surface and a lower surface, wherein the upper surface defines a step surface, further wherein the top plate has first and second opposite ends in contact with a first and second intervening sides to provide a first, second, third, and fourth corners. The top plate has a central longitudinal axis.

The stool further comprises four protrusions integral with the lower plate surface with each protrusion separately located proximal to the first, second, third, and forth corners and aligned approximately perpendicular to the intervening sides. Each protrusion comprises a distal and proximal end with the distal and proximal ends facing towards and away from the central longitudinal axis, respectively. The proximal end of each protrusion faces the nearest intervening side. Each of the protrusions has a hollow core to provide four hollow cores (i.e., two pairs of female cores) approximately cylindrical in shape.

The collapsible stool also comprises two legs, each leg having a top and bottom part, wherein the top part comprises two opposite facing male protrusions each adapted to fit a female core and visa versa to enable each leg to rotate through an arc between an open position and a closed position relative to the top plate, wherein at least one of each pair of female cores comprise an integral leg securing mechanism adapted to maintain each leg in an open position relative to the top plate.

In one aspect of the invention, the integral locking mechanisms comprise an internal groove describing an arc inside the at least one of each pair of female cores to provide at least two female cores with grooves. Each groove has a first end and a second end, wherein at least one male member of each leg comprises a complimentary projection adapted to slide along the groove as the leg and associated male member is rotated through an arc between a leg closed position and a leg open position.

In one embodiment, the groove describes an arc of approximately 100°, with a preferred arc of about 90° and more preferably about 95°, wherein a first end of the groove corresponds to a leg's closed position with the other end of the groove corresponding to a leg's open position such that a leg's complimentary projection rests up against the second end of the groove, which acts as a backstop preventing the leg collapsing outwards when a child is standing on the step surface of the collapsible stool.

In a further aspect of the invention, the bottom part of each leg comprises a non-slip material to minimize the possibility of accidental slippage of either leg when placed in an open position onto a floor.

In one embodiment of the invention, the step surface comprises a non-slip material to help avoid accidental slippage of a child's foot relative to the top plate of the collapsible stool.

In a further aspect of the invention, each leg and the lower surface further comprises a leg attachment means to attach the legs to the lower surface when the stool is not in use.

It is an object of the invention to provide improved elements and arrangements thereof in an apparatus for the purposes described which is inexpensive, dependable and fully effective in accomplishing its intended purposes.

These and other aspects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention involves an improved portable collapsible stool. The principles of the present invention, however, are not limited to collapsible stools and it will be understood that, in light of the present disclosure, the collapsible stool disclosed herein can be successfully used in connection with other types of stool and supports.

Additionally, to assist in the description of the components of the collapsible stool, words such as left, right, up, down, front and rear are used to describe the accompanying figures. It will be appreciated, however, that the collapsible stool can be located in a variety of different positions and orientations-including at various angles, sideways and even upside down. A detailed description of the collapsible stool now follows.

It should be understood that the term "small children" refers to children under about forty pounds (lbs) in weight.

Figure 1:
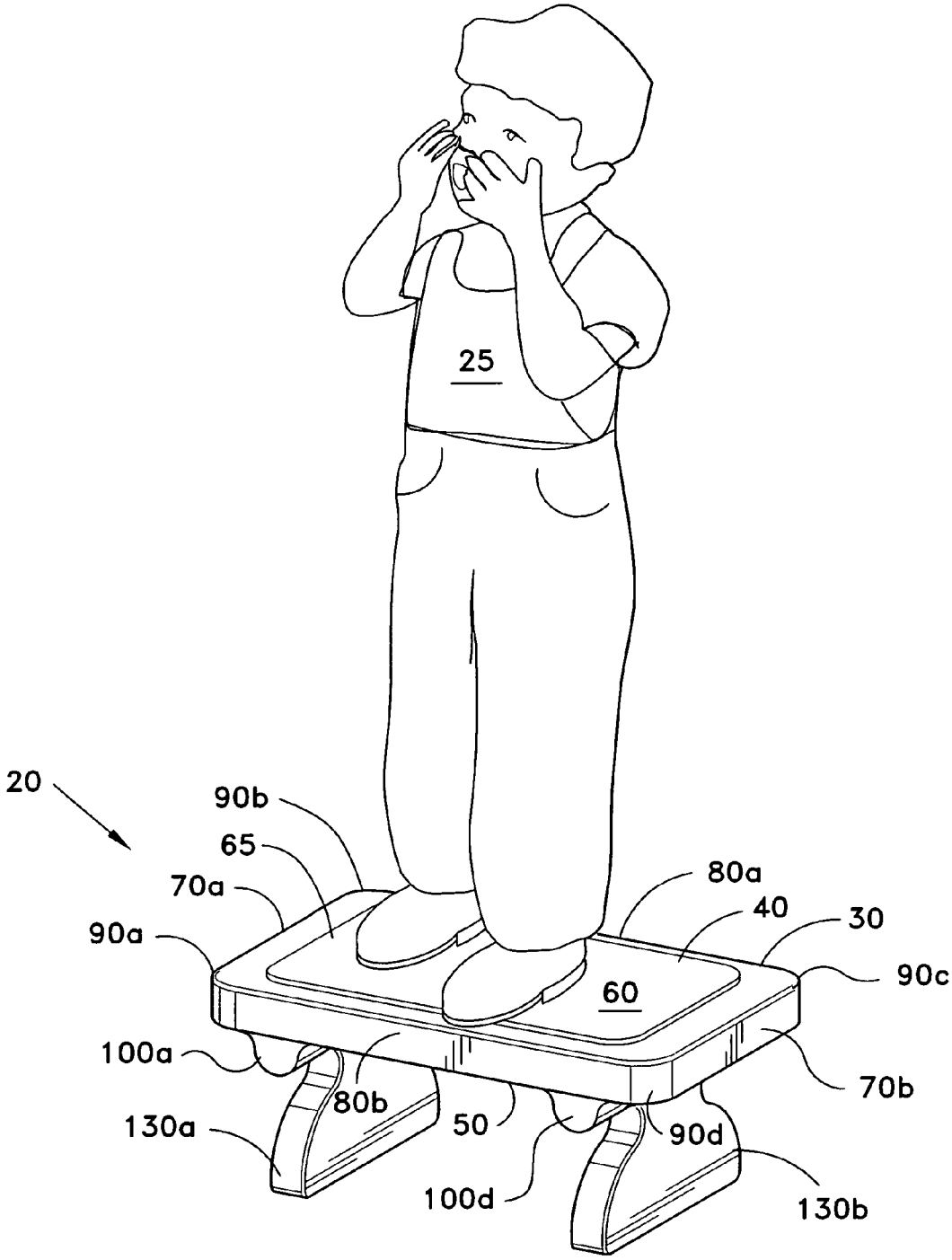
FIG. 1 is an environmental, perspective view of a collapsible stool according to the present invention.
Figure 2:
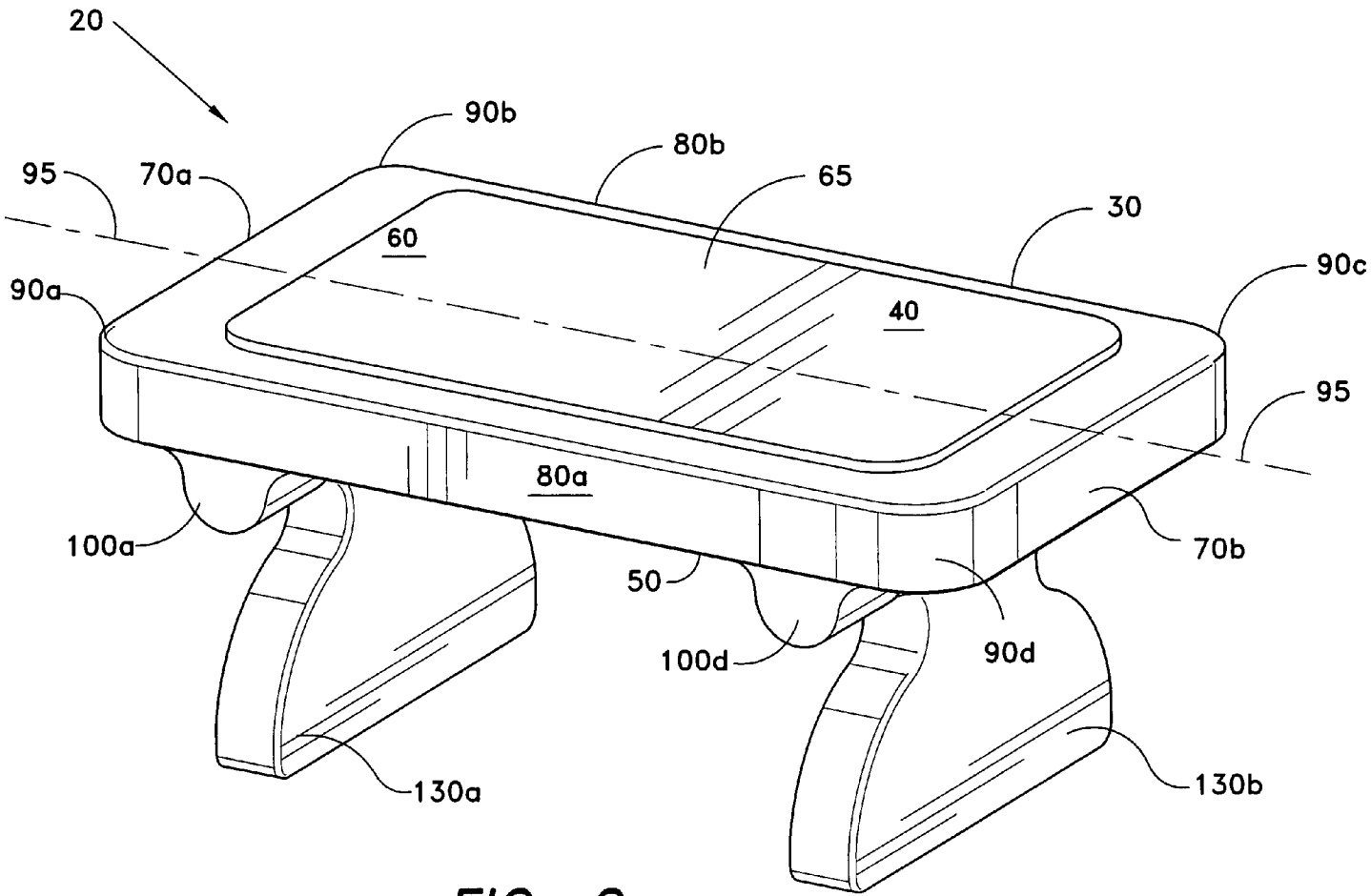
FIG. 2 is a perspective view of a collapsible stool according to another aspect of the present invention.

Referring to the drawings in general and FIGS. 1 and 2 in particular, a perspective view of a portable collapsible stool 20 is shown being used to support a small child 25 in accordance with one aspect of the present invention. In general, the stool 20 includes a substantially horizontal top plate 30 of generally rectangular shape with an upper plate surface 40 and a lower plate surface 50, wherein the upper surface 40 defines a step surface 60, which may comprise a non-slip layer 65 made of non-slip material, such as a rubber layer. The top plate 30 (also referred to as "top plate 30") has a first 70*a* and second 70*b* opposite ends in contact with a first 80*a* and second 80*b* intervening sides to provide a first 90*a*, second 90*b*, third 90*c*, and fourth 90*d* corners, 30 having a central longitudinal axis 95. It should be understood that the corners 90 may vary and take the form of, for example, rounded corners, or square corners. In addition, the top plate 30 may take the form of an oval shape in which case the oval shape can be considered as an oval shape wrapped around an imaginary rectangle shape comprising four imaginary corners.

Figure 3:
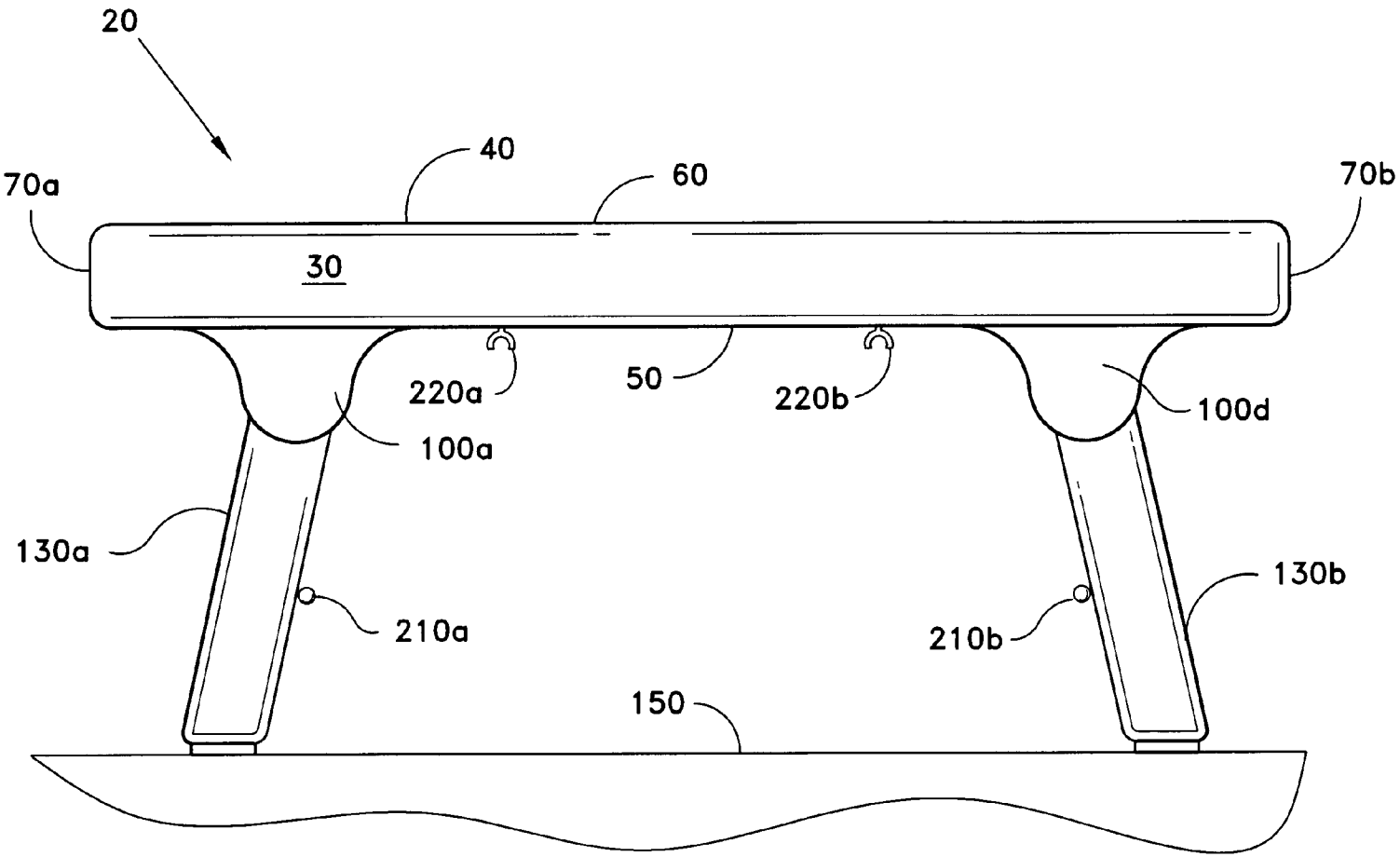
FIG. 3 is a side view of a collapsible stool according to another aspect of the present invention, including a leg attachment apparatus.
Figure 4:
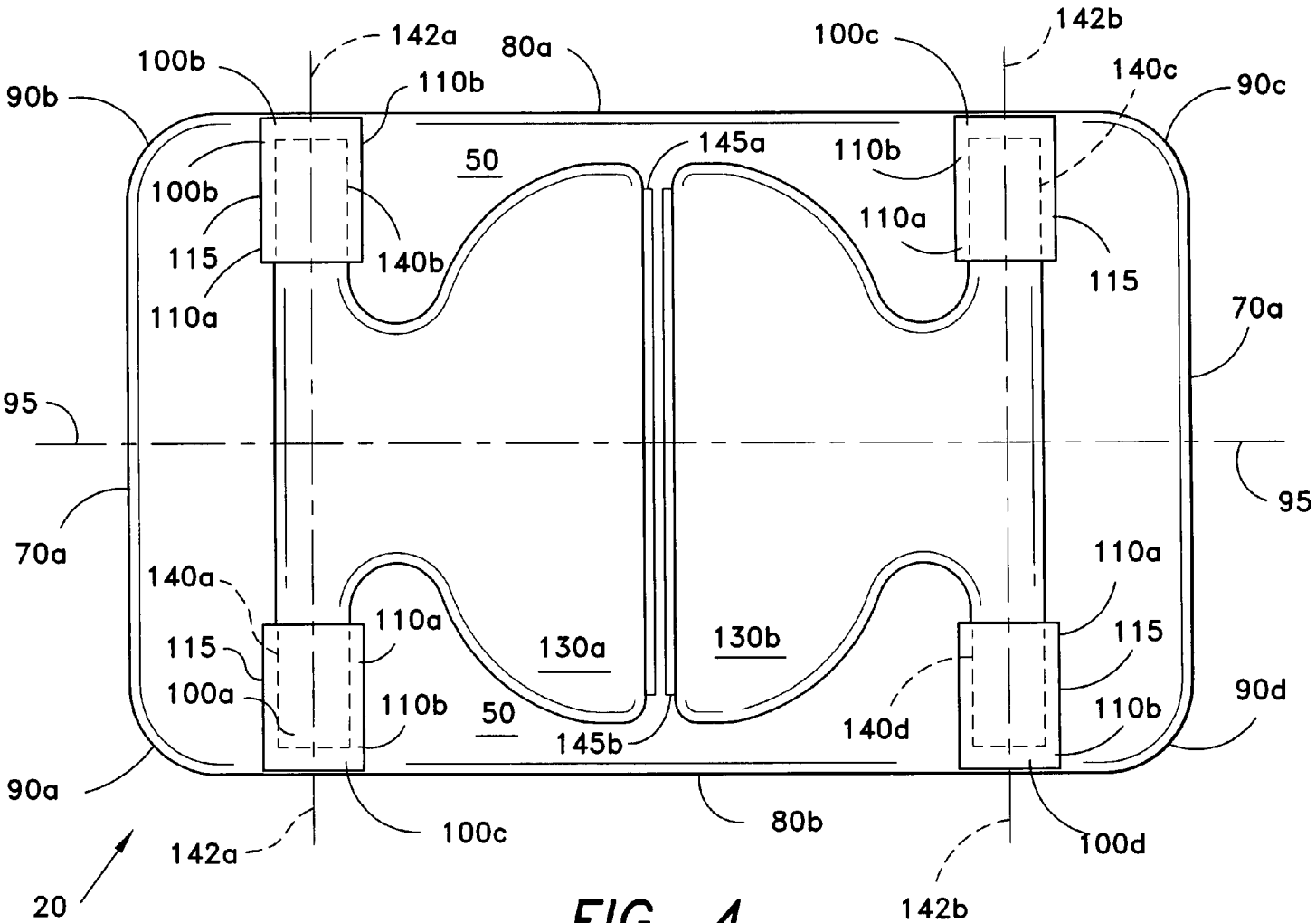
FIG. 4 is a bottom view of a collapsible stool according to another aspect of the present invention, including two legs shown in a closed position.

Referring to FIGS. 2, 3, and 4, the stool 20 further comprises four female protrusions 100*a*, 100*b*, 100*c*, and 100*d* (only 100*a* and 100*b* shown in FIG. 2) integral with the lower plate surface 50 and each separately located proximal to the first 90*a*, second 90*b*, third 90*c*, and fourth 90*d* corners of lower surface 50, respectively, and aligned approximately perpendicular to the intervening sides 80*a* and 80*b*, each protrusion comprising a proximal 110*a* and distal 110*b* end. The proximal end 110*b* faces towards the central longitudinal axis 95. The distal end 110*b* faces away from the central longitudinal axis 95 and towards the nearest intervening side 80*a* or 80*b*.

Figure 8:
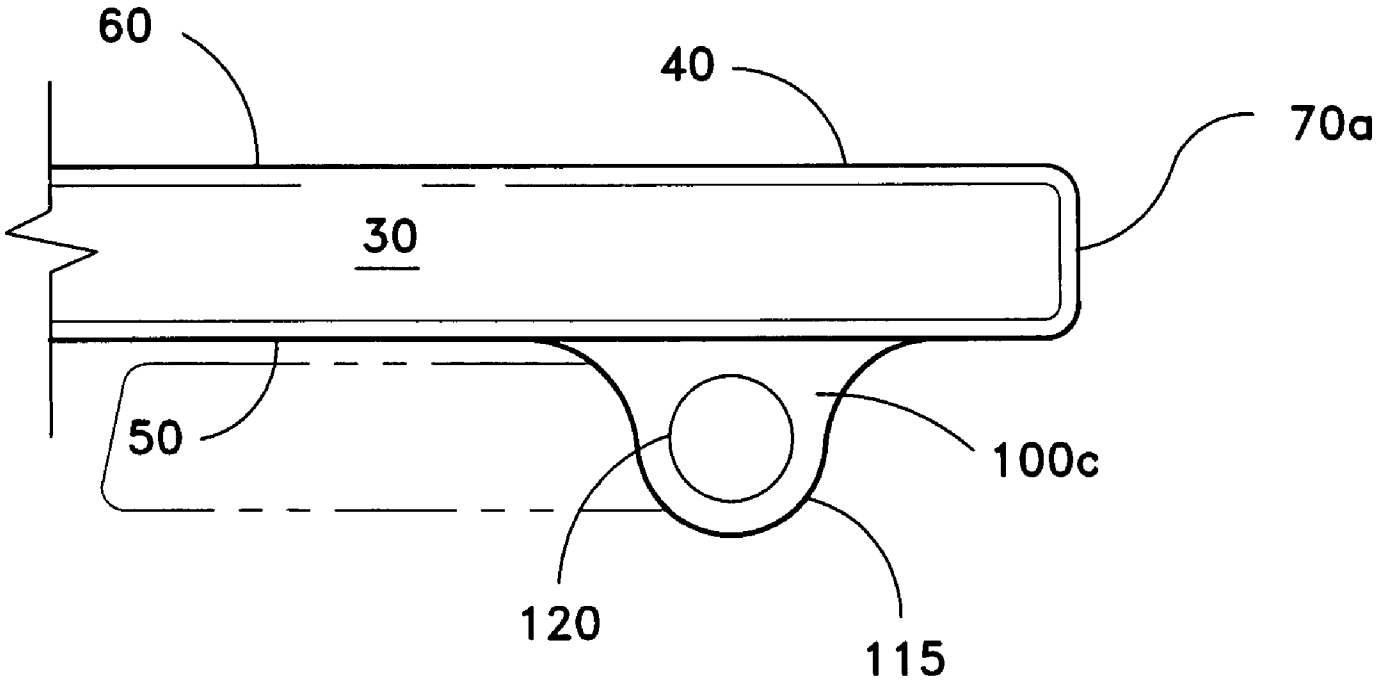
FIG. 8 is a fragmentary side view of a collapsible stool protrusion assembly according to another aspect of the present invention.
Figure 9:
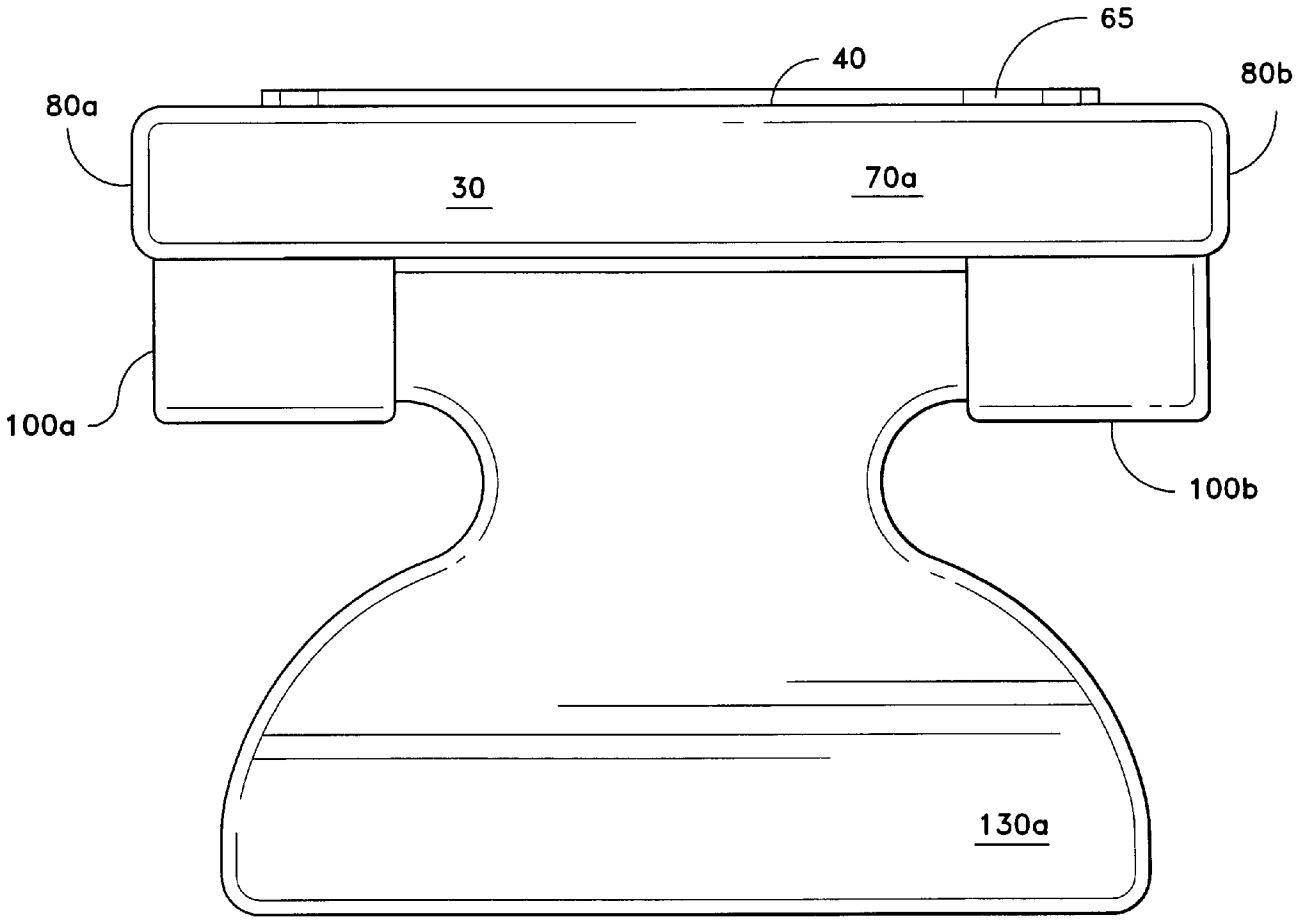
FIG. 9 is an end view of a collapsible stool with a leg in an open position according to another aspect of the present invention.

Each protrusion 100 comprises a housing 115 defining a hollow female core 120 (e.g., see FIG. 8) to provide two pairs of female cores (120*a*/120*b* and 120*c*/120*d*) approximately cylindrical in shape. In the event that the top plate 30 takes the form of an oval shape, the protrusions 100 may be positioned proximal to virtual corners 90 corresponding to a virtual rectangle which fits inside the oval shape as described above.

Figure 5:
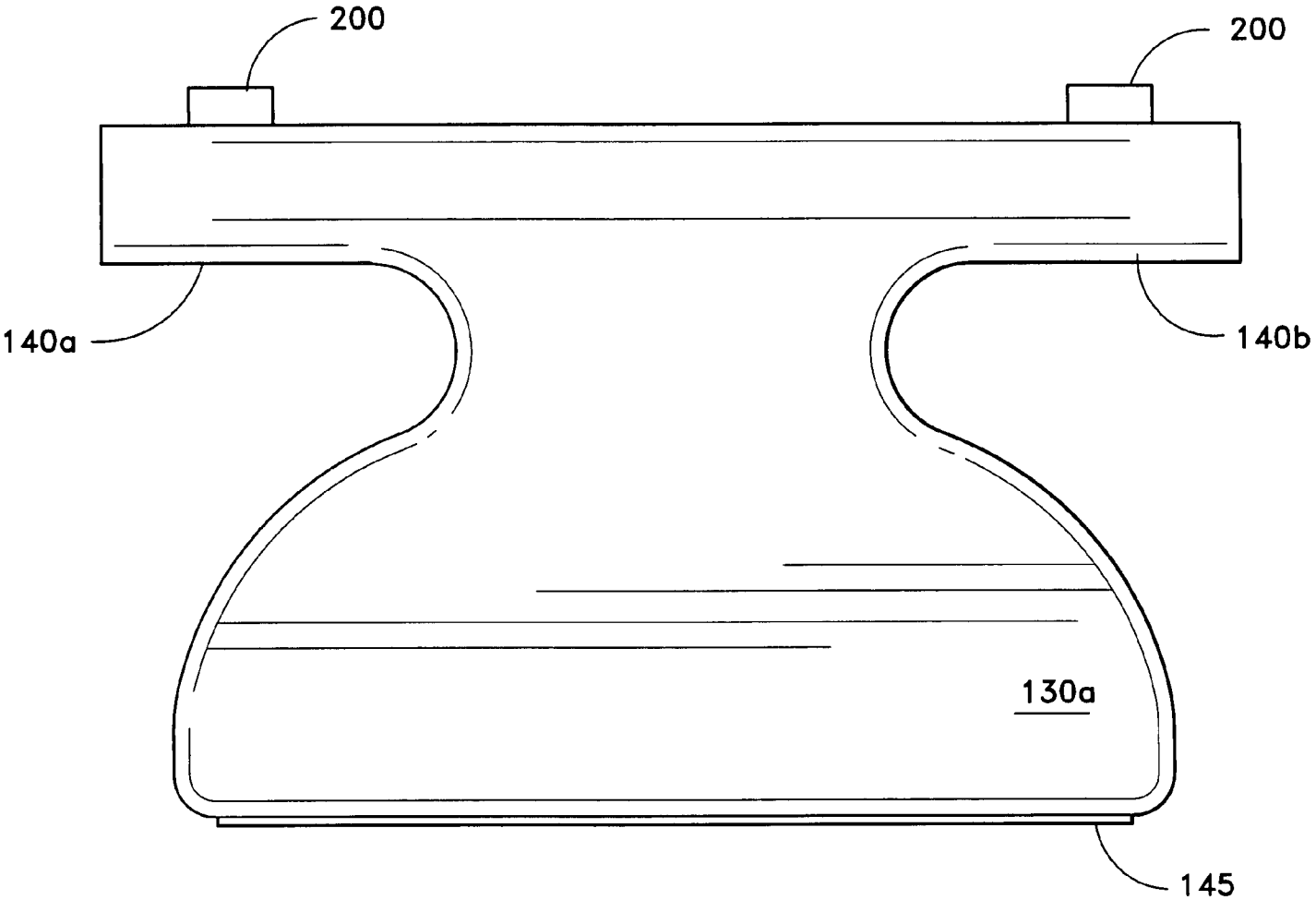
FIG. 5 is a front or back view of a leg according to one aspect of the present invention.

The stool 20 further comprises oppositely disposed first and second legs 130*a* and 130*b* of generally planar construction, which are shown in an open position, for example, in FIGS. 1 to 3, and in closed positions in FIG. 4. The upper part of leg 130*a* comprises a first male member 140*a* and a second male member 140*b* (see FIGS. 5 and 7); and the upper part of leg 130*b* comprises a male member 140*c* and male member 140*d*. The female housings 115 are disposed to accommodate male members 140 by virtue of female cores 120. Each pair of male members 140 preferably share a common traverse axis such as 142*a* and 142*b* (see FIG. 4), and each leg has a central longitudinal axis 132*a* and 132*b* (132*b* is shown in FIG. 6).

Figure 6:
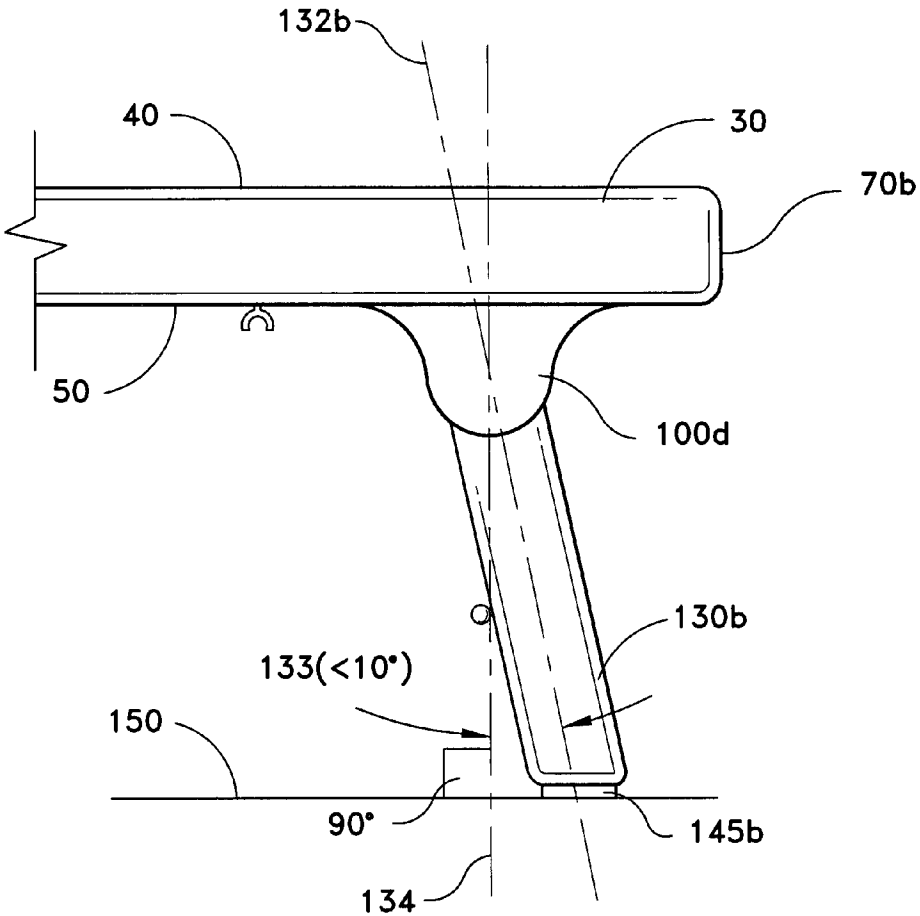
FIG. 6 is a fragmentary side view of a collapsible stool according to another aspect of the present invention.
Figure 7:
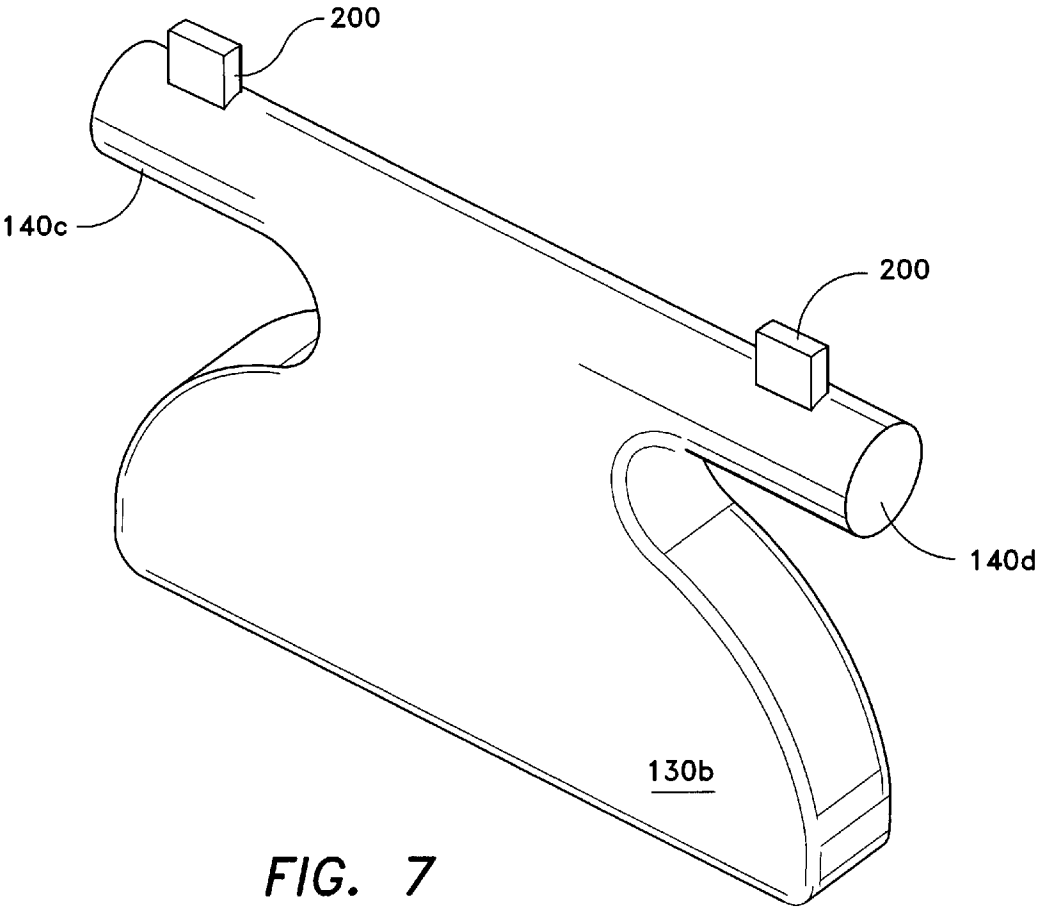
FIG. 7 is a perspective view of a collapsible stool leg, according to another aspect of the present invention, and shows a pair of complimentary projections attached to two male members.
Figure 11:
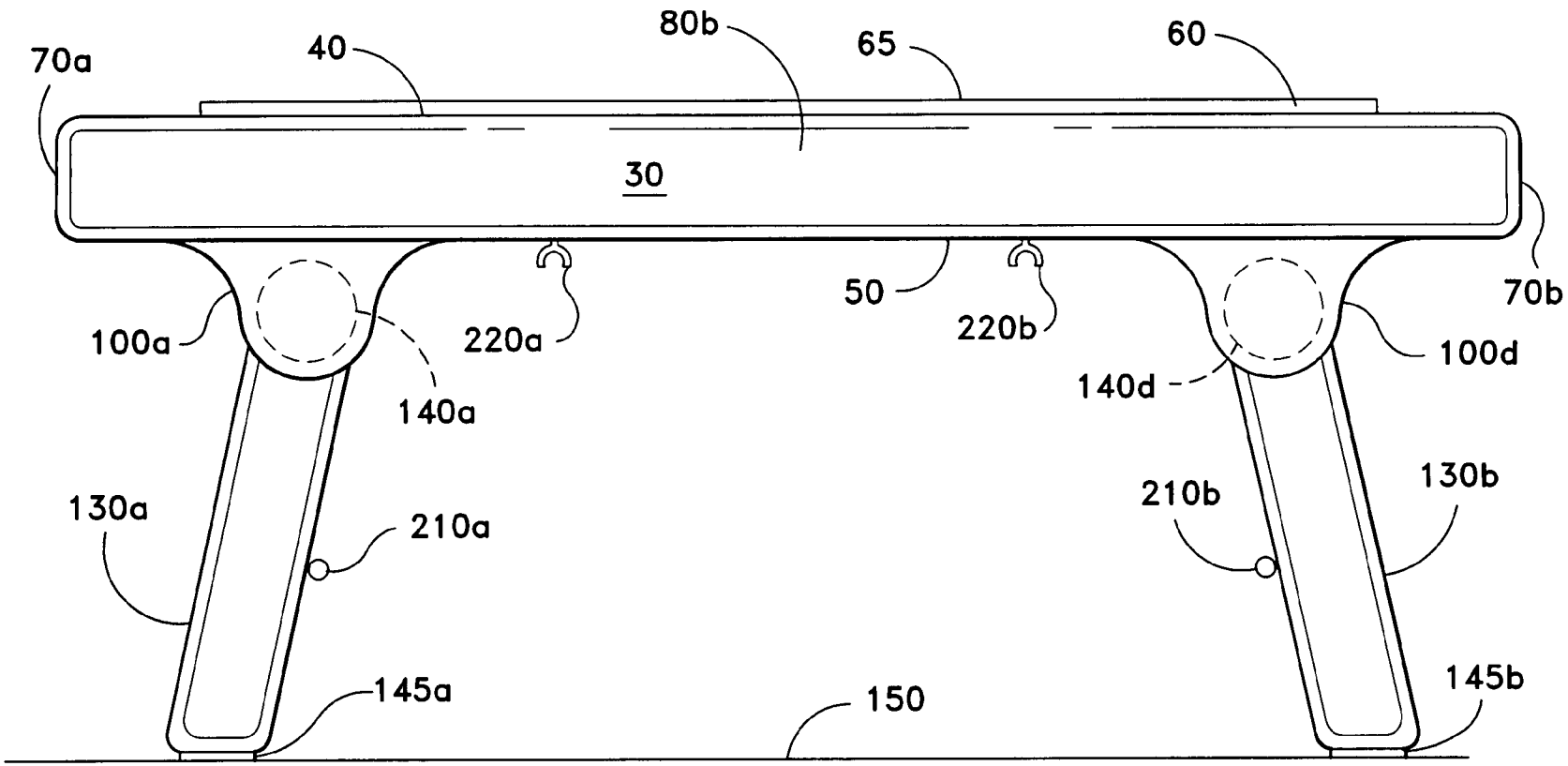
FIG. 11 is a side view of a collapsible stool according to another aspect of the present invention.

In the open state, the outward angle 133 between the plane axis 132*a* or 132*b* and the ground 150 (i.e., the angle 133 between the axis 132*b* and the perpendicular line 134 shown in FIG. 6 is preferably less than about 15° (equivalent to an angel of about 105° with respect to the top plate 30), and more preferably less than about 10° (equivalent to an angel of about 100° with respect to the top plate 30) and still more preferably is less than about 5° (equivalent to an angel of between 90° and about 105° with respect to the top plate 30), with the legs 130 preferably splayed slightly outwards as shown, for example, in FIGS. 3, 6, and 11.

In one embodiment of the invention, the legs 130*a* and 130*b* (collectively referred to as "130") are perpendicular to the ground when in an open position with the corresponding angle 133 of about 0°. In this position the legs 130 are in an open position ready to bear the weight of a small child 25. When the angle 133 is about 0° (equivalent to an angel of about 90° with respect to the top plate 30) the legs 130 are most efficient at supporting a child 25 under about forty pounds. In one embodiment of the invention, the bottom part of each leg comprises a non-slip material 145*a* and 145*b*, which assists in minimizing slippage when the legs 130*a* and 130*b* are in the open position and in contact with the ground 150. In a further embodiment, the stool 20 can be easily carried with the legs 130*a* and 130*b* neatly folded up against the lower surface 50 as shown in FIG. 4.

In one embodiment of the invention, the legs 130 are attached to the lower surface 50 by means of an attachment mechanism, which can be any suitable means of attaching the legs 130 to the lower surface 50. It is preferred that the attachment mechanism snaps the legs 130 into the undersurface 50. For example, in one embodiment the attachment mechanism, as shown in FIG. 3, each leg 130 comprises a male attachment member 210 (shown as 210*a* and 210*b*, also see FIG. 11) which mates with a female attachment member 220 (shown as 220*a* and 220*b*) to keep the legs 130 (shown as 130*a* and 130*b*) attached to the underside of the top plate 50. In this embodiment the male attachment member 210 is pushed against the female attachment member 220 by applying a force to each leg 130 to bring the male attachment member 210 into contact with the female attachment member 220 and snapping the male attachment member 210 into the female attachment member 220. Each leg 130 may by released by applying a force in the opposite direction causing the male attachment member 210 to release from the female attachment member 220.

It will be understood that the attachment members 210 and complementary attachment members 220 may vary in their exact configuration. For example, the attachment members 210 and 220 may adopt a female and complementary configurations, respectively.

In one embodiment of the invention, the integral securing mechanisms comprise an internal groove 170 describing an arc inside the at least one of each pair of female cores to provide at least two female cores 120 with grooves 170. In this embodiment of the invention each groove 170 has a first end 180 and a second end 190, wherein at least one male member 140 of each leg 130 comprises a complimentary projection 200 (see FIGS. 5 and 7) adapted to slide along the groove 170 as the leg 130 and associated male member 140 is rotated through an arc between the leg's 130 closed position (as depicted in FIG. 4) and leg's 130 open position (e.g., see FIGS. 1, 2, 3, and 11); the groove 170 describes an arc of about 100°, and preferably between about 90° and about 95°, wherein a first end 180 of the groove 170 corresponds to the leg's 130 open position and the second end 190 corresponds to the leg's 130 closed position such that the leg's projection 200 rests up against the second end 190 of the groove 170, which acts as a backstop preventing the leg 130 from splaying or collapsing outwards, with respect to the top plate 30, when a child 25 is standing on the step surface 60 of the collapsible stool 20.

Figure 10A:
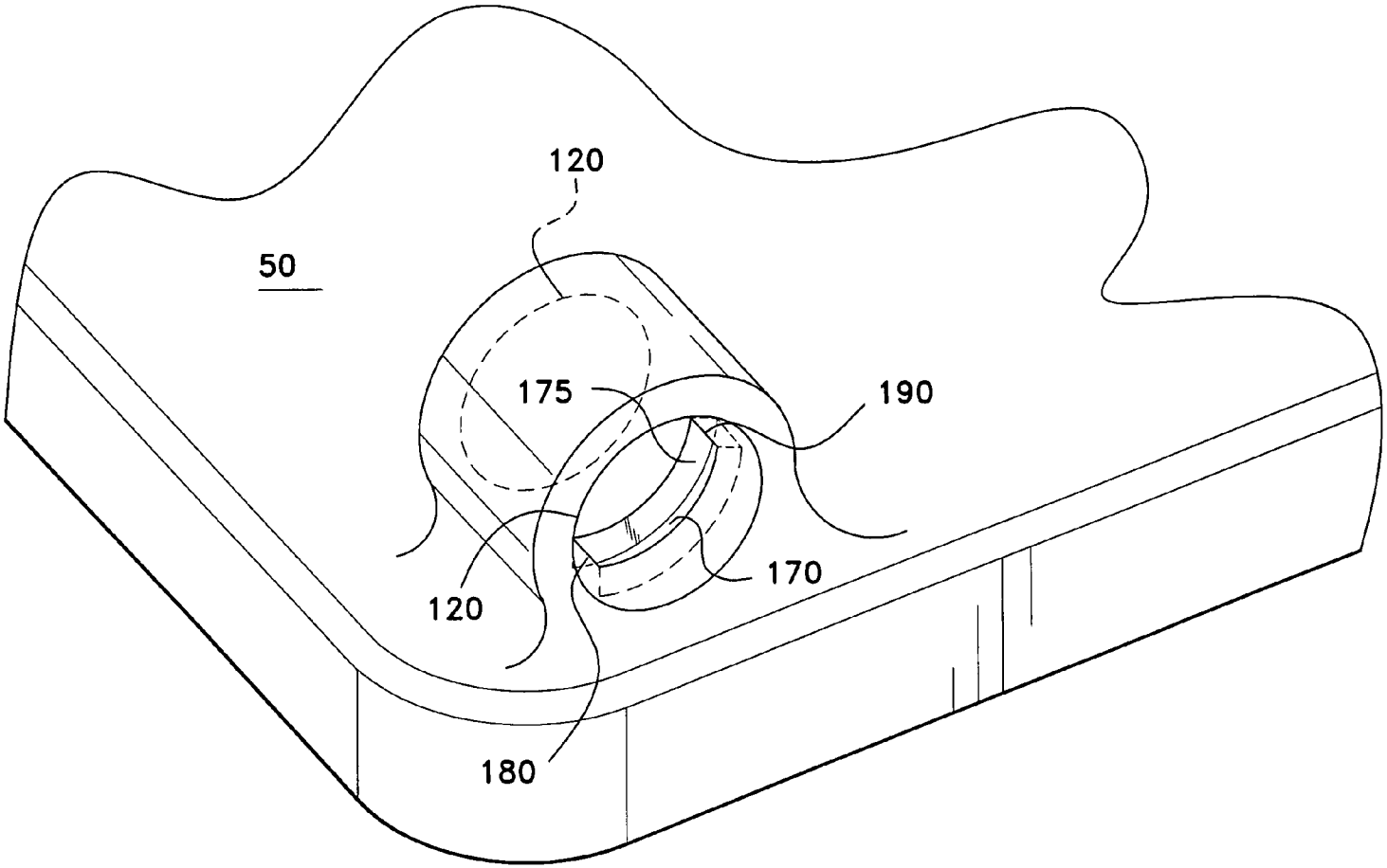
FIG. 10A is a perspective side view of a collapsible stool showing a groove inside a female core according to another aspect of the present invention.
Figure 10B:
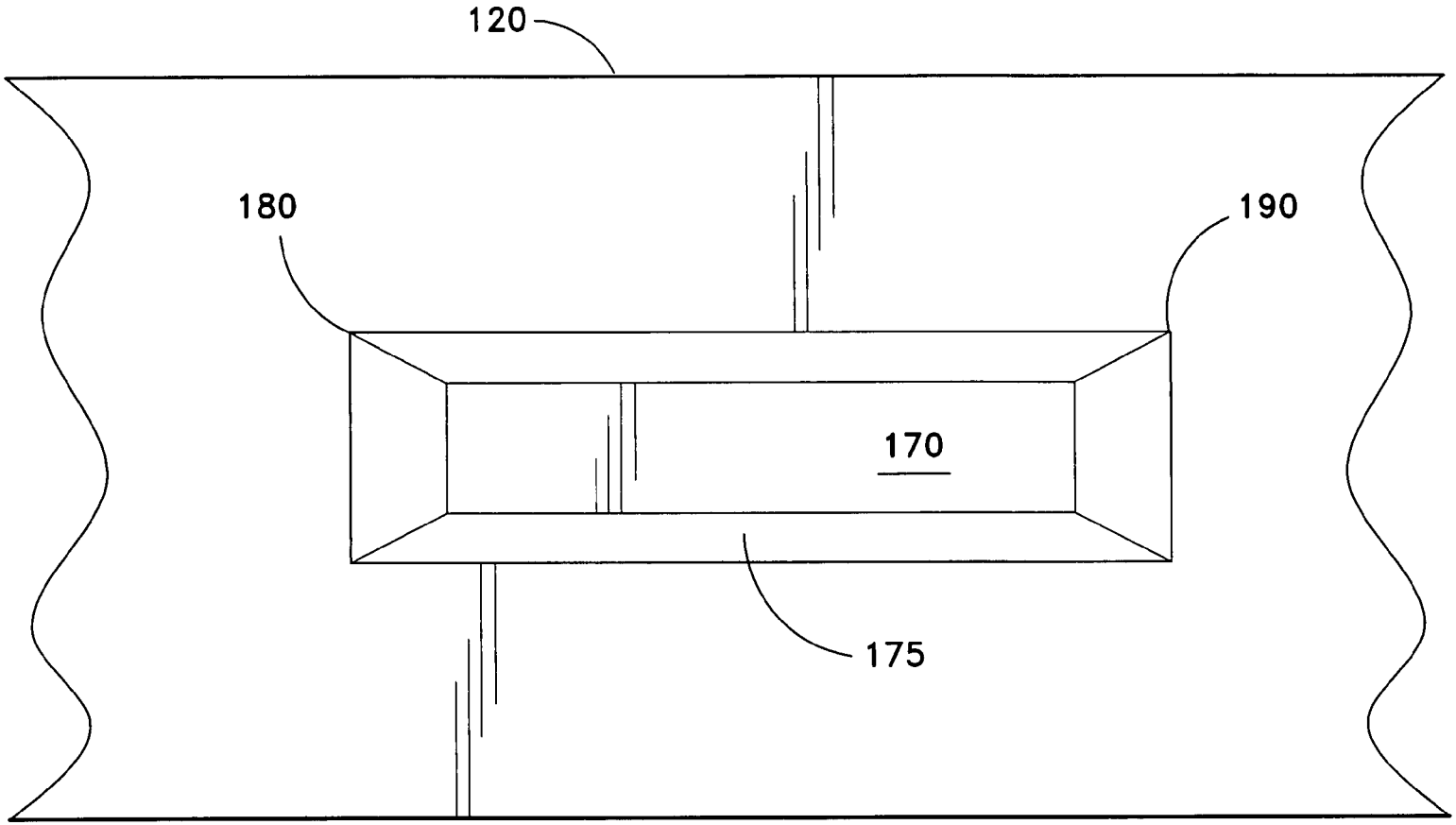
FIG. 10B is a top view of a groove according to another aspect of the present invention.

One embodiment of the groove 170 is shown in a side perspective view of a female core 120 defined by housing 115 (see FIG. 10*a*). The groove 170 is shown in an imaginary rolled out flat form in FIG. 10*b*, with the sides 175 of the groove 170 clearly visible.

In a further embodiment of the invention, the groove 170 has a first portion of the groove 170 with a depth slightly less than the depth of the projection 200 and a final portion of the groove 170 with a depth corresponding to the dimensions of the projection 200, so that when the leg male member with projection 200 is rotated from a closed position to an open position, the projection 200 slides with difficulty along the first portion of the groove 170 until reaching the final portion of the groove 170 which is adapted to accurately accommodate the complimentary projection 200. Upon reaching the final portion of the groove 170 corresponding to the open position of leg 130, the projection 200 pops into the final portion of the groove 170 such that a person rotating the leg 130 would notice that the leg 30 is now at its fully extended open position.

It should be understood that the exact arrangement and configuration of the leg security mechanism can be varied. The invention as described herein is not to be limited by a particular embodiment showing a particular groove 170 or complimentary projection 200 configuration. Specifically, variations, changes, modifications and departures from the groove 170 and projection 200 arrangement disclosed above may be adopted without departure from the scope or spirit of the present invention.

In another embodiment of the invention, an adult such as a parent, grips one of the legs 130 and rotates the leg 130 causing the male members 140 of the leg to simultaneously rotate inside the female cores 120. The complimentary projection 200 follows the groove 170 until reaching notch (not shown) whereupon the complimentary projection 200 occupies the notch to keep the leg 130 in the open position. To return the leg 130 to the closed position, the adult may flex the leg 130 and top plate 30 proximate to the groove 170 and notch vicinity to disengage the security mechanism by popping the complimentary projection 200 free of the notch. The leg 130 may then be moved into the closed position (as depicted in FIG. 4).

It should be understood that the type of locking mechanism may vary, but it should be of simple design to minimize the number of parts that make up the collapsible stool of the present invention. While any suitable material may be used to manufacture the collapsible stool of the invention, the preferred material is a molded plastic material, which is preferably pleasing aesthetically and also provides a safe supporting structure capable of supporting a small child's weight. The choice of plastic material is not critical, but should be of resilient material of sufficient rigidity to hold the load of a small child but of sufficient flexibility to permit some bending when a force greater than that provided by a small child's weight is applied to the vicinity of the locking mechanism to disengage the locking mechanism as described above. Legs 130 and top plate 30 can be constructed from a number of different types of well known moldable plastic materials such as polyethylene, polypropylene and like materials, including acrylonitrile butadiene styrene (ABS).

The dimensions of the collapsible stool 20 may vary. In one embodiment, the width of the top plate 30 is about half the length of the top plate 30; the width of the legs 130 is about the same as the width of the top plate 30 and the height of the legs 130 is less than about the width of the legs 130. The preferred length and width of the top plate 30 is about 12 inches and 6 inches, respectively; and the height and width of the legs 130 is about 6 inches and 6 inches, respectively.

In one embodiment, the circumference of the male member 140 is about the same or slightly less than the circumference of the core 120. The protrusion housing 115 is dimensioned to accommodate the dimensions of the core 120. In addition, the invention includes other permutations that might be found in U.S. Provisional Patent Application Ser. No. 60/422,090. U.S. Provisional Patent Application Ser. No. 60/422,090 is incorporated herein by reference in its entirety.

It is to be understood that the present invention is not limited to the sole embodiments described above, but encompasses any and all embodiments within the scope of the following claims.

We claim:

1. A collapsible stool to provide additional height for small children who require height assistance, comprising in combination, a substantially horizontal top plate of generally rectangular shape with an upper surface and a lower surface, wherein the upper surface defines a step surface, further wherein the top plate has a first and second opposite ends in contact with a first and second intervening sides to provide a first, second, third, and forth corners, the top plate having a central longitudinal axis;

four female protrusions integral with the lower surface and each separately located proximal to a respective first, second, third, and forth corners and aligned approximately perpendicular to the intervening sides, each protrusion comprising a distal and a proximal end, wherein the proximal end faces away from the central longitudinal axis and towards the nearest intervening side, wherein each protrusion is host to a female hollow core to provide two pairs of female cores approximately cylindrical in shape, wherein at least one of each pair of female cores comprises an internal groove that defines an arc; and two legs of generally planar construction, each leg having a top and bottom part, wherein the top part defines two opposite facing male members, the male members are configured to fit the female cores, wherein at least one male member of each leg comprises a projection adapted to slide along the groove enabling each leg to rotate through an arc thereby defining a leg open position and a leg closed position relative to the top plate.

2. The collapsible stool according to claim 1, wherein the groove describes an arc of about 100°.

3. The collapsible stool according to claim 1, wherein the groove describes an arc of between about 90° and 95°.

4. The collapsible stool according to claim 1, wherein the groove has a first end that corresponds to a leg open position, and a second end of the groove that corresponds to a leg closed position relative to the top plate.

5. The collapsible stool according to claim 1, wherein the groove defines a first end and a second end, wherein the first end corresponds to a leg open position, and the second end defines a backstop for the leg projection such that when the leg projection abuts against the backstop the attached leg is in the open position relative to the top plate and is unable to spray or collapse outwards when a child stands on the top plate of the stool.

6. The collapsible stool according to claim 1, wherein the legs are made from a moldable plastic.

7. The collapsible stool according to claim 1, wherein the legs are made of a material selected from the group consisting essentially of: polyethylene, polypropylene, and acrylonitrile butadiene styrene.

8. The collapsible stool according to claim 1, wherein the top plate is made from a moldable plastic.

9. The collapsible stool according to claim 1, wherein the top plate is made of a material selected from the group consisting essentially of: polyethylene, polypropylene, and acrylonitrile butadiene styrene.

10. The collapsible stool according to claim 1, wherein each leg in the open position makes an angle between about 90° and 105° with respect to the top plate.

11. The collapsible stool according to claim 1, wherein each leg is fitted with an attachment member, and the lower surface of the top plate is fitted with a complementary attachment members to attach the legs to the lower surface of the top plate when the stool is not in use.

* * * * *